US007347255B2

(12) United States Patent
Fischer et al.

(10) Patent No.: US 7,347,255 B2
(45) Date of Patent: Mar. 25, 2008

(54) DEVICE FOR DETECTING WATER IN PRODUCT-ONLY PUMP FLOW STREAM

(75) Inventors: David A. Fischer, Ann Arbor, MI (US); Craig A. Bamm, Ann Arbor, MI (US)

(73) Assignee: QED Environmental Systems, Inc., Ann Arbor, MI (US)

( * ) Notice: Subject to any disclaimer, the term of this patent is extended or adjusted under 35 U.S.C. 154(b) by 246 days.

(21) Appl. No.: 11/091,912

(22) Filed: Mar. 28, 2005

(65) Prior Publication Data

US 2005/0211432 A1 Sep. 29, 2005

Related U.S. Application Data

(60) Provisional application No. 60/557,438, filed on Mar. 26, 2004.

(51) Int. Cl.
*E21B 43/12* (2006.01)
*E21B 44/00* (2006.01)

(52) U.S. Cl. ..... 166/54; 166/75.12; 210/121

(58) Field of Classification Search ..... 166/75.12, 166/54, 250, 250.15
See application file for complete search history.

(56) References Cited

U.S. PATENT DOCUMENTS 2,820,865 A * 1/1958 McKinnies ..... 200/84 R
3,815,416 A * 6/1974 Portis ..... 73/306
3,963,374 A * 6/1976 Sullivan ..... 417/12
5,049,037 A * 9/1991 Carson et al. ..... 417/36
5,474,685 A * 12/1995 Breslin ..... 210/741
6,039,546 A * 3/2000 Edwards et al. ..... 417/61

FOREIGN PATENT DOCUMENTS

GB 2291710 A * 1/1996

* cited by examiner

*Primary Examiner*—Jennifer H. Gay
*Assistant Examiner*—Sean D Andrish
(74) *Attorney, Agent, or Firm*—Harness, Dickey & Pierce, PLC

(57) ABSTRACT

A device for detecting the presence of water in a product-only hydrocarbon pump system particularly used for the removal of subterraneous hydrocarbons from a remediation site through a well. The device comprises a sealed float switch chamber, positioned either upstream or downstream from the hydrocarbon pump, wherein when a threshold amount of water is present in the hydrocarbon product being pumped through the float chamber, a switch is actuated by the float mechanism, electrically signaling an alarm, shutting off the power supply to the pump, or further activating a system controller or log.

9 Claims, 2 Drawing Sheets

DEVICE FOR DETECTING WATER IN PRODUCT-ONLY PUMP FLOW STREAM

CROSS-REFERENCE TO RELATED APPLICATIONS

This application claims the benefit of U.S. Provisional Application No. 60/557,438, filed on Mar. 26, 2004. The disclosures of the above application are incorporated herein by reference.

FIELD OF THE INVENTION

The present invention relates to pumps used in the removal of hydrocarbons and hydrocarbon containing products from wells. More specifically, this invention relates to a method of detecting the presence of water in the hydrocarbon product being extracted from the well.

BACKGROUND OF THE INVENTION

The improper disposal of hydrocarbons and the leakage of hydrocarbons from underground storage tanks has resulted in contamination of the ground and groundwater beneath every city and town in the developed countries of the world. Many techniques have been developed to remediate soil and groundwater contaminated with hydrocarbons.

"Pump and dispose" is a common method of remediating a soil contaminated with hydrocarbons by use of one or more in-ground pumps. This method uses one or more wells to extract the contaminating hydrocarbons from the ground water. Often times it becomes difficult, especially with multiple pumps operating at a single remediation site to remove only the floating hydrocarbons from the remediation site, and not the underlying ground water. This problem is multiplied where systems employing multiple pumps discharging into a single manifold make it even more difficult to discern which pumps are operating properly, and which pumps are drawing water in combination with the floating fuel or hydrocarbon product out through the well.

In order to maintain a properly working and efficient "product-only" pump system used to extract hydrocarbon or fuel contamination present in a given remediation site, it is necessary to devise a means of detecting when water is present in one or more of the discharge lines of each pump, so proper steps can be taken to remedy the situation for the one or more pumps which are drawing water and product in from the well without having to check each individual pump, thereby minimizing down time of the system.

SUMMARY OF THE INVENTION

In accordance with the present invention, a method of detecting the presence of water in a product-only hydrocarbon or fuel pump discharge is provided. This means of detecting the presence of water is embodied in a gravity-specific float actuated switch chamber positioned adjacent to the hydrocarbon pump either upstream or downstream, but preferably on the output of the pump, which actuates a switch when a predetermined quantity of water is present in the hydrocarbon discharge, and thus the switch chamber.

The gravity-specific float is located in a chamber through which the discharge of the pump is directed through. The float is designed to sink in the chamber when only hydrocarbon is present, but will float when a predetermined amount of water is drawn in. When this threshold amount of water becomes present in the hydrocarbon discharge, the float rises in the chamber actuating a sealed reed switch. The reed switch can either electrically close or open a circuit which activates an alarm, shuts off the power supply to the pump, or activates a "tank full" shut-off switch input on a control system or monitor such as a QED Model C100 controller, SCADA system or any other signal or data processor known to one skilled in the art.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
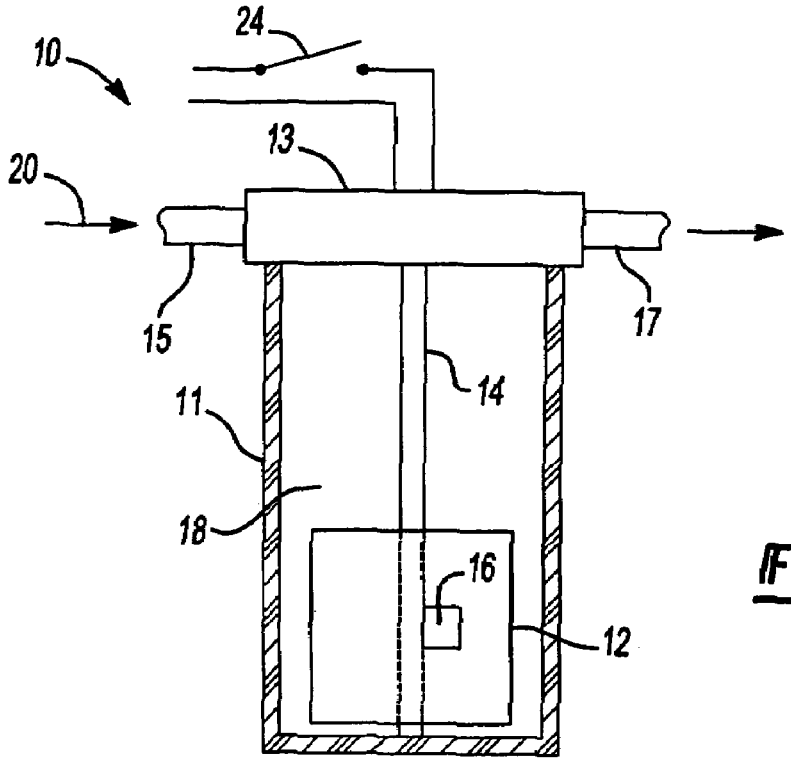
FIG. 1 is a cross-sectional side view of the inline float-actuated switch chamber of the present invention with no water present in the chamber.

Referring now to FIG. 1, the preferred embodiment of the present invention is shown generally comprising a gravity-specific float-switch assembly 10, positioned inline with a hydrocarbon or fuel removal pump for removal of such from an in-ground well of a remediation site. The float-switch assembly 10 as previously mentioned, may be positioned either upstream or downstream from the pump, but preferably is positioned adjacent the pump's output, receiving an inflow of hydrocarbon product indicated by arrow 20 from the pump.

The float-switch assembly 10 comprises an upright, elongated, sealed chamber housing 11 defining a specific internal volume, with a sealing chamber head 13 having an inlet 15 and output 17 for receiving and discharging the hydrocarbon product 18. A reed switch 24, positioned on the float guide rod 14 is connected through a circuit to either the pump, an alarm or other system controller, and is actuated when a threshold amount of water is present in the chamber.

A vertically positioned float guide rod 14 is located within the housing 11, defining a guide upon which float member 12 slideably travels in the vertical axis thereupon. The float member 12 can be of any generally sealed float element having a gravity-specific density, which results in a vertical translation up the guide rod 14 only when a predetermined threshold amount of water 22 is present in the assembly 10, as shown in FIG. 2.

The float member 12 further comprises a magnet element 16 imbedded in the float member 12, for actuating the sealed reed switch 24 installed within the float guide rod 14, when brought within close proximity thereto.

Figure 2:
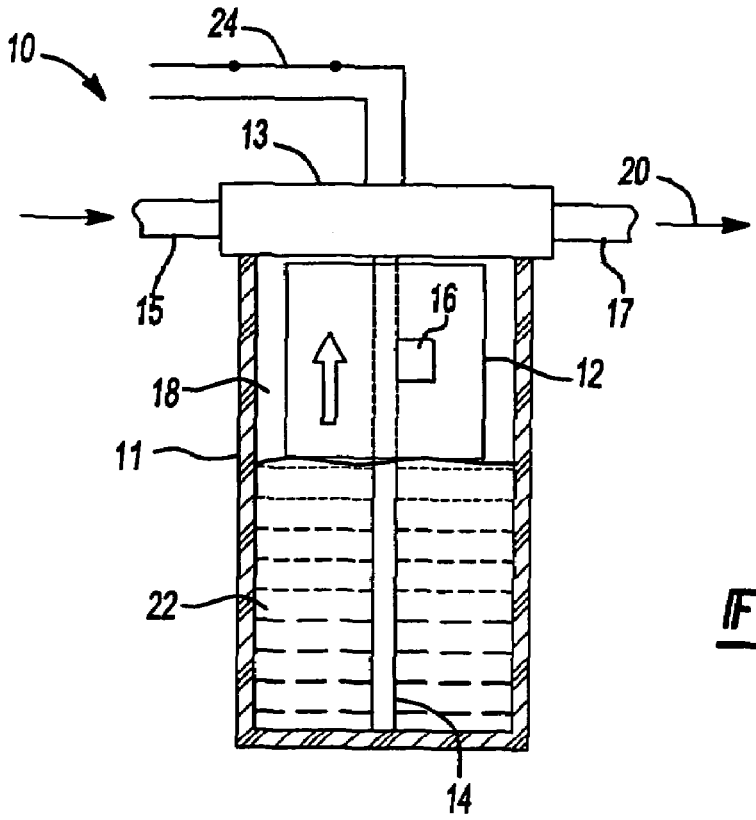
FIG. 2 is a cross-sectional side-view of the inline float-actuated switch chamber of the present invention with a threshold amount of water present in the chamber.
Figure 3:
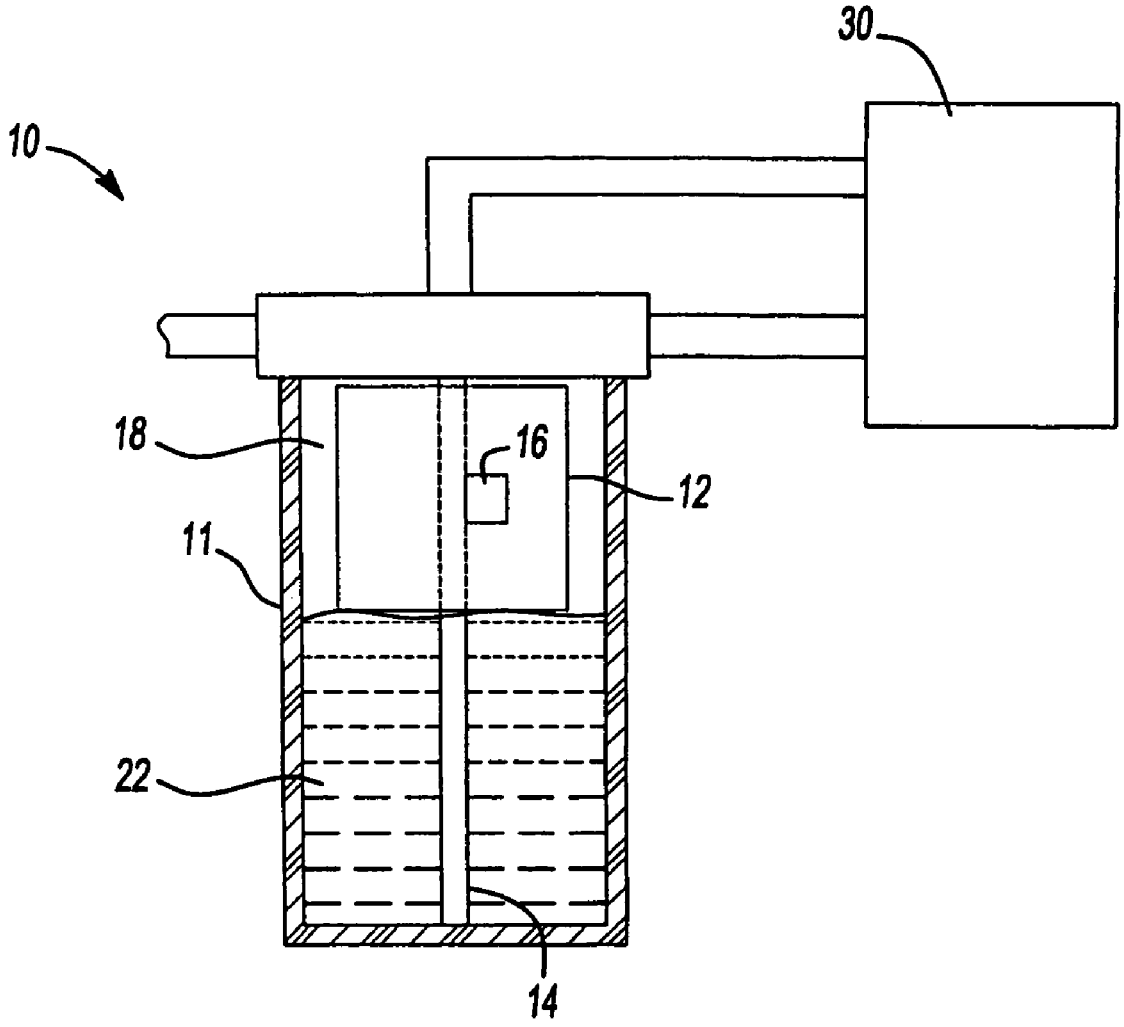
FIG. 3 illustrates a cross-sectional side-view of the inline float-actuated switch chamber of the present invention with a threshold amount of water present in the chamber, connected to a data processor or signaling device.

As shown in FIGS. 2 and 3, when a predetermined threshold amount of water 22 becomes present in the hydrocarbon product 18 delivered into the housing 11 by the product-only pump, the normally sunken float member 12 rises up vertically within the housing 11, due to the given specific gravity of the water 22. The magnet element 16 of the float member 12 thereby comes in close proximity to a reed switch 24 closing (or in the alternative, opening) a circuit which in turn activates an alarm, shuts off the power supply to the pump, or activates a "tank full" shut-off switch input on a control system or monitor, shown generally as reference numeral 30 in FIG. 3, such as a QED Model C100 controller, SCADA system or any other signal or data processor known to one skilled in the art.

The amount of water necessary in the housing 11 to actuate the float member 12 enough to change the state of the reed switch can vary, based upon the specific gravity of the float member 12 but generally is within the range of one hundred ml to two L, and preferably set to trigger the reed switch 24 by approximately one L of water 22.

Once a signal is provided indicating that water is present in a particular float switch assembly, one can easily service that single pump to correct the matter without having to discern which pump in a series is drawing water in with the hydrocarbon product.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A device for detecting the presence of water in a hydrocarbon pump system for pumping hydrocarbon-based materials from a subterraneous remediation site comprising:

a sealed float chamber, said float chamber positioned adjacent to and in fluid connectivity with a hydrocarbon pump, said chamber having an input for receiving hydrocarbon product and an output for discharging hydrocarbon product;

a gravity-specific float member slidable along a vertical axis contained within said float chamber, said float having a magnetic element imbedded inside said float member;

a sealed switch inside a float guide rod actuated by said magnetic element of said float member coming within close proximity of said sealed switch only when a predetermined amount of water is present in said sealed float chamber, with the hydrocarbon-based material;

said predetermined amount of water becomes present in the sealed float chamber when said hydrocarbon pump draws in water present in said subterraneous remediation site in combination with hydrocarbon-based material from said subterraneous remediation site, said actuated sealed switch completes an electrical circuit.

2. The device for detecting the presence of water in a hydrocarbon pump system as defined by claim 1 wherein the amount of water present in said sealed float chamber to actuate said sealed switch is within the range of 100 milliliters to 2 liters.

3. The device for detecting the presence of water in a hydrocarbon pump system as defined by claim 1 wherein said sealed float chamber is positioned upstream of said hydrocarbon pump.

4. The device for detecting the presence of water in a hydrocarbon pump system as defined by claim 1 wherein said sealed float chamber is positioned downstream of said hydrocarbon pump.

5. The device for detecting the presence of water in a hydrocarbon pump system as defined by claim 1 wherein said electrical circuit when completed, activates an alarm.

6. The device for detecting the presence of water in a hydrocarbon pump system as defined by claim 1 wherein said electrical circuit when completed, shuts off the power supply to said hydrocarbon pump.

7. The device for detecting the presence of water in a hydrocarbon pump system as defined by claim 1 wherein said electrical circuit when completed, activates a "tank full" shut-off switch input on an integrated control system.

8. A device for detecting the presence of water in a hydrocarbon pump system for pumping hydrocarbon-based materials from a subterraneous remediation site comprising:

a sealed float chamber, said float chamber positioned adjacent to and in fluid connectivity with a hydrocarbon pump, said chamber having an input for receiving hydrocarbon product and an output for discharging hydrocarbon product;

a gravity-specific float member slidable along a vertical axis contained within said float chamber, said float having a magnetic element imbedded inside of said float member;

a sealed switch inside a float guide rod actuated by said magnetic element of said float member coming within close proximity of said sealed switch only when a predetermined amount of water is present in said sealed float chamber with the hydrocarbon-based material;

said predetermined amount of water becomes present in the sealed float chamber when said hydrocarbon pump draws in water present in said subterraneous remediation site in combination with hydrocarbon-based material from said subterraneous remediation site, said actuated sealed switch completes an electrical circuit, said electrical circuit activating at least one device from the list comprising an alarm, a pump shut-off switch, a tank-full indicator, a system controller.

9. A device for detecting the presence of water in a hydrocarbon pump system for pumping hydrocarbon-based materials from a subterraneous remediation site comprising:

a sealed float chamber, said float chamber positioned to and in fluid connectivity with a hydrocarbon pump, said chamber having an input for receiving hydrocarbon product and an output for discharging hydrocarbon product;

a gravity-specific float member slidable along a vertical axis contained within said float chamber, said float having a magnetic element imbedded inside of said float member;

a sealed switch inside a float guide rod actuated by said magnetic element of said float member coming within close proximity of said sealed switch only when a predetermined amount of water is present in said sealed float chamber with the hydrocarbon-based material;

said predetermined amount of water becomes present in the sealed float chamber when said hydrocarbon pump draws in water present in said subterraneous remediation site in combination with hydrocarbon-based material from said subterraneous remediation site, said actuated sealed switch breaks an electrical circuit.

* * * * *